US005484266A

United States Patent [19]

Murga

[11] Patent Number: 5,484,266

[45] Date of Patent: Jan. 16, 1996

[54] HIGH SPEED ELECTRICALLY DRIVEN AXIAL-FLOW PUMP AND BOAT DRIVEN THEREBY

[76] Inventor: José Murga, 9, chemin des Rouillères, CH-2000 Neuchatel, Switzerland

[21] Appl. No.: 313,233

[22] PCT Filed: Feb. 3, 1994

[86] PCT No.: PCT/CH94/00023

§ 371 Date: Oct. 19, 1994

§ 102(e) Date: Oct. 19, 1994

[87] PCT Pub. No.: WO94/18458

PCT Pub. Date: Aug. 18, 1994

[30] Foreign Application Priority Data

Feb. 3, 1993 [CH] Switzerland ..... 00304/93

[51] Int. Cl.[6] ..... F04B 49/06

[52] U.S. Cl. ..... 417/44.1; 417/42; 417/44.1; 417/355; 417/356; 415/91

[58] Field of Search ..... 417/42, 44.1, 44.11, 417/355, 356, 410.1, 420, 423.7, 423.14; 415/72, 91; 310/62, 63; 318/254

[56] References Cited

U.S. PATENT DOCUMENTS

| | | | |
|---|---|---|---|
| 1,347,732 | 7/1920 | Cooper . | |
| 1,714,330 | 5/1929 | Tucker | 417/355 |
| 2,113,213 | 5/1938 | Leonard | 417/355 |
| 2,274,274 | 2/1942 | Pezzillo . | |
| 2,697,986 | 12/1954 | Meagher . | |
| 3,119,342 | 1/1964 | White | 310/63 |
| 3,143,972 | 8/1964 | Smith et al. | 415/91 |
| 3,273,506 | 9/1966 | Jamieson . | |
| 3,719,436 | 3/1973 | McFarlin . | |

FOREIGN PATENT DOCUMENTS

| | | | |
|---|---|---|---|
| 0169682 | 1/1986 | European Pat. Off. . | |
| 0404299 | 12/1990 | European Pat. Off. . | |
| 0452538 | 10/1991 | European Pat. Off. | 417/355 |
| 1087184 | 2/1955 | France . | |
| 2726948 | 1/1979 | Germany | 310/68 R |
| 3718954 | 12/1988 | Germany . | |
| 4111466 | 10/1992 | Germany . | |
| 91/19103 | 12/1991 | WIPO . | |

*Primary Examiner*—Richard A. Bertsch
*Assistant Examiner*—Xuan M. Thai
*Attorney, Agent, or Firm*—Davis, Bujold & Streck

[57] ABSTRACT

An axial-flow pump combined with an electric motor coaxially arranged therearound. The rotor (1) and stator (2) are common to both the electric motor and the pump. The rotor comprises a central tubular portion (11) defining a central channel (14) with a wall (15) provided with blades (16). The blades preferable do not extend as far as the channel axis (3) so that they define a central free area therealong. The outer portion of the rotor (1) has pairs of permanent magnets (24, 25) with stator coils (9) therebetween. The coils are actuated and deactuated by an electronic switching device (28) controlled by sensors (36, 37) for sensing markings on the rotor. The length of the rotor is smaller than its outer diameter. Said pump may be used to pump liquids or gases and drive vehicles, particularly submarines.

16 Claims, 4 Drawing Sheets

HIGH SPEED ELECTRICALLY DRIVEN AXIAL-FLOW PUMP AND BOAT DRIVEN THEREBY

The instant invention concerns a high speed electrically driven axial-flow pump consisting of a stator in a sealed casing, a rotor located inside the stator casing which rotates on an axis, said rotor comprising a tubular central portion that forms one exterior wall of the central axial channel through which fluid passes continuously and which supports the blades in said channel, and electromagnetic drive means which have magnets disposed along said tubular central portion of the rotor, said magnets cooperating with the electrical coils in the stator located inside the sealed casing.

The invention further concerns a boat driven by such a pump.

An electrically driven pump is usually separate from the motor and connected to it by a rotating shaft. Generally the two devices are coaxial in order to eliminate discharges caused when gears or other transmission devices mesh. However, this arrangement has specific disadvantages in the case of an axial-flow pump. The machines may each be disposed in the extension of the other and separated by an elbow in the fluid inlet or outlet channel, but in this case the shaft obstructs fluid flow in the elbow. Alternatively, the electric motor could be located in a bulbous area located in the center of the fluid channel, with one end of the bulb supporting a large helix. In this situation the fluid flow path would also deviate axially to a significant extent in order to skirt the bulb. All these deviations cause energy loss, increase bulk and make it difficult to augment fluid speed. Furthermore, the shaft and the pump wheel are less stable at high speeds; therefore, the shaft supports need to be reinforced and consequently, the liquid loses even more power.

To avoid the problems described above, one known solution uses a rotor that is common to the pump and the electric motor with a central tubular portion serving as the pump wheel and a peripheral portion comprising the rotor elements of the electric motor. For example, an axial pump of the type described in the preamble is shown in FIGS. 5–13 of European Patent No. 0 169 682. It is driven by a squirrel cage type motor. The result is a rotor that is relatively long in relation to its diameter and which, in addition, is not capable of rotating at very high speed. Consequently, the axial channel and the pump blades must also be fairly long to transmit enough power to the fluid. In the embodiment described, the blades are formed by a spiral axial body placed in the central channel; they have an elongate central element which poses the problem of reducing the fluid passage section. U.S. Patent No. 3 719 436 shows the same type of pump with an induction motor presenting similar problems. The pump blades are supported by the wall of the central channel, however, so that the center of the channel is free.

Publication No. WO 91/19 103 describes a miniature blood pumping device with a configuration essentially analogous to the embodiments described above, but with a generally stator-like central body which traverses the rotor axially so that the central channel is annular in shape, causing considerable loss of power. Here again the rotor is relatively long and speed is intentionally limited (16,500 rotations per minute) to prevent damage to the blood cells.

The object of the present invention is to perfect such a combined axial-flow pump and electric motor with a common rotor and with the hydraulic and electrical elements arranged concentrically, allowing very high rotation speeds and resulting in a highly powerful, compact pump. A specific object is for the pumping fluid to flow in as straight a line as possible with few obstructions.

A first characteristic of the invention concerns a pump of the type described in the preamble, characterized in that the length of the rotor is smaller than its outer diameter.

Thus, since the poles of the electrical device are relatively far away from the axis of rotation, the magnetic attraction and repulsion forces acting thereupon are very effective and produce a high degree of motor coupling. The blades transmitting the motor force to the fluid may be disposed along a relatively short central channel.

The blades are preferably helicoidal and and closely spaced. The central channel may be essentially cylindrical and the separations between the helices may be smaller than the channel diameter. The central channel may also have a tapered design, particularly if the fluid being pumped is compressible.

In a particularly advantageous embodiment of the invention, the blades are attached to said outer wall of the central channel and do not extend as far as the axis of rotation, so a free central zone runs along the entire length of the channel.

In a preferred embodiment of the pump the magnets on the rotor are disposed in pairs with two magnets of each pair being axially separated by an interval allowing an essentially uniform magnetic field to be generated from one magnet to the other, and the stator coils are formed by flattened spirals arranged in a circle on a radial plane located in the intervals between the rotor magnets, so that each coil is essentially perpendicular to the lines of the magnetic field in these intervals. The rotor magnets are preferably permanent magnets, especially in a small machine, but they may also be electromagnets.

The electromagnetic drive means are preferably provided with control means comprising at least one position sensor attached to the stator and emitting a signal indicating the angular position of the rotor, and electronic switching means designed to actuate and dictate the stator coils individually as a function of the signal from the position sensor or sensors. As a result the machine can be continuously supplied with current and no rotor switch is required. A peripheral channel for circulating cooling fluid may surround each coil in the stator.

Another embodiment of the invention concerns a boat driven by pumps such as those described above, characterized in that each pump is housed in a streamlined body located in the water outside the keel of the boat and is traversed by an axial channel comprising said central channel of the pump rotor.

Yet another embodiment of the invention concerns a boat driven by pumps such as those described above, having at least two propulsion channels which are essentially longitudinally disposed inside the boat and each traversing one of said pumps. Each channel has an inlet at the front of the boat and a longitudinally directed outlet at the rear of the boat. The inlet and the outlet of each of the two propulsion channels are respectively situated on opposite sides of a longitudinal central axis of the boat.

Other characteristics and advantages of the invention will be apparent from the following description of one embodiment and with reference to the attached drawings, wherein.

Figure 1:
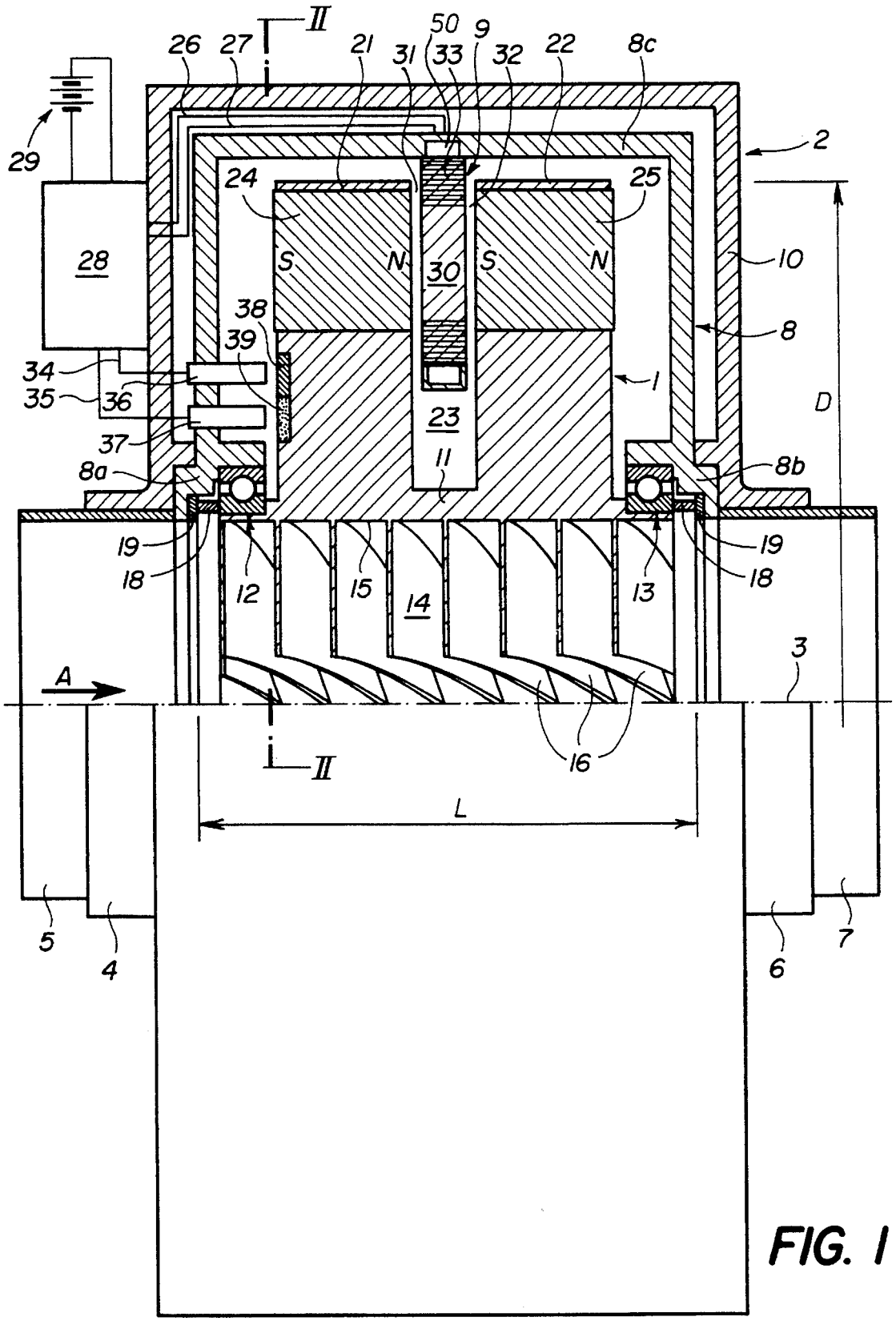
FIG. 1 is a schematic partially in cross-section of an axial-flow pump according to the invention designed for pumping liquid.
Figure 2:
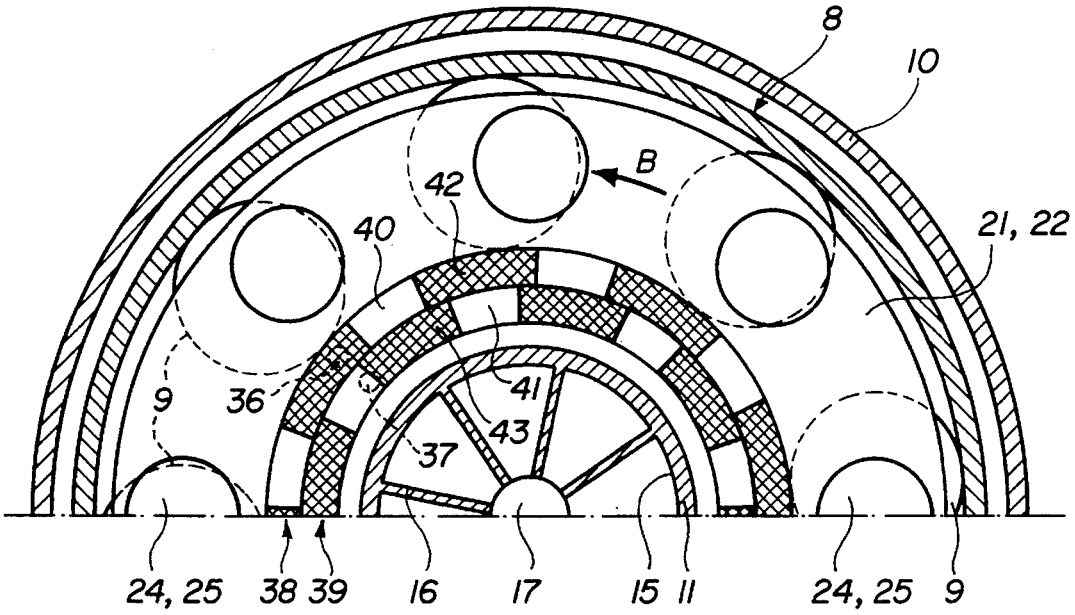
FIG. 2 is a cross-section taken along lines II—II of FIG. 1, slightly reduced in scale.

The pump shown in FIGS. 1 and 2 comprises a rotor 1 turning inside a generally cylindrical stator 2, the longitudinal axis of which constitutes the axis of rotation 3 of the rotor. Stator 2 has an axial inlet opening 4 connected to a suction tube 5 and on the opposite side, an axial outlet opening 6 connected to a delivery tube 7, while tubes 5 and 7 may be any type of tube belonging to the circuit of pumped liquid flowing in the direction of arrow A. The stator has a sealed interior casing 8 surrounding rotor 1, with an annular arrangement of flattened electrical coils 9 on a radial plane, and an outer frame 10 with openings 4 and 6 mechanically connecting interior casing 8 and tubes 5 and 7.

Note that rotor 1 is common to the pump itself, which comprises the central portion of the machine, and to the electric motor which directly surrounds the pump. In effect, rotor 1 comprises a central tubular portion 11, the extremities of which are attached to the stator by beatings 12 and 13, such as ball bearings or magnetic or pneumatic bearings. This tubular portion 11 defines a rectilinear central channel 14 with a peripheral wall 15 which, in the example shown, is a cylinder of regular section, equal in size to the interior section of tubes 5 and 7. Naturally in other executions the central channel might have a variable section, particularly for pumping compressible fluid. Central channel 14 contains a series of helicoidal blades 16 which are pre-eminent on the peripheral wall 15 and which do not extend as far as the axis of rotation 3, so that a free central zone 17 remains in the area of axis 3 along the entire length of the pump. This free area facilitates the manufacture of blades 16 and more importantly, eliminates most of the risk of foreign material obstructing the pump. Since there is no central body in this area, the liquid particles virtually do not deviate in a radial direction. Furthermore, since the section is fairly regular, liquid particle speed varies very little, except for the tangential component of helicoidal movement caused by blades 16. Because the rotor rotates at very high speed, the blades are relatively closely spaced, that is, the blades form a narrow angle of inclination in relation to a radial plane throughout most of the transverse portion of channel 14 (this angle is greater in the areas closer to axis 3 ). As a result the pressure exerted by the blades on the fluid has a strong axial component and a weak tangential component. Typically the distance separating the helices is smaller than the diameter of channel 14.

At each extremity of the central rotor portion 11 there is a friction ting 18 which cooperates with an annular rubber gasket 19 attached to the stator to seal the fluid circuit. These seals need not be perfectly sealed, as they need only prevent sizable leaks during suction and, in addition, the stator casing 8 seals the exterior. The interior of the stator may be a vacuum or it may contain a pressurized light gas.

Figure 3:
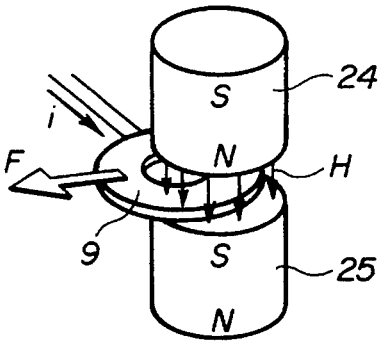
FIG. 3 is a perspective schematic view showing the action of the electric pump motor.

Surrounding the central tubular portion 11, rotor 1 comprises two parallel discs 21 and 22 which are symmetrical and separated by an axial interval 23 containing the circular arrangement of stator coils 9. Opposite the coils, discs 21, 22 support pairs of permanent magnets 24, 25 which are polarized parallel to axis 3 and arranged so that the north pole N of each magnet 24 on disc 21 is located opposite the south pole S of the corresponding magnet 25 on disc 22. As shown in FIG. 3, the resulting magnetic field H is essentially uniform and constant in the space between the two magnets. A ferromagnetic cylinder head (not shown) may be provided to close the lines of the field in the rotor or in the stator, depending upon the materials used. In this example eight pairs of magnets 24, 25 are provided, being equidistant from one another on the perimeter of the rotor.

To facilitate assembly the sealed interior casing 8 for the stator 2 is subdivided into eight shell sections 8*c*, each extending 45° and supporting a coil 9. Together these shells form two circular tings 8*a* and 8*b* which support beatings 12, 13. The outer casing 10 may be formed of two semi-circular pieces joined in an axial plane. Shells 8*c* are traversed by pairs of conductors 26, 27 which pass between casing 8 and frame 10, traversing the letter and connecting to an electronic switch 28 that controls the electricity supply to each coil 9 from a continuous voltage source of electrical energy. 29. Each coil is flattened and has a ferromagnetic core 30, separated from magnets 24, 25 by small spaces 31, 32 between the poles, and surrounded by circular electrical coils 33 having a diameter approximately equal to the magnet diameter. However, it is possible for the coils and the magnets to be shaped differently from the circular elements shown here. As shown in FIG. 2, coils 9 are also eight in number, so that all the pairs of magnets 24, 25 on the rotor are opposite a coil 9 at the same time.

Via conductors 34 and 35, the electronic switching device 28 receives the electrical output signals from two optical sensors 36 and 37 cooperating with circular tracks 38 and 39 arranged on a front surface of rotor 1, which turns in the direction of arrow B. Each track 38, 39 has angular markings comprising white areas 40, 41 and black areas 42, 43. The output signal from each sensor 36, 37 is either high or low depending upon whether a white zone or a black zone is facing the sensor. It is possible obtain the same output signals using a different type of sensor, for example, a magnetic sensor cooperating respectively with metal and non-metal areas on tracks 38 and 39. Device 28 is designed to connect coils 9 to supply source 29 in a first direction when the signal from sensor 36 is high and in the opposite direction when the signal from sensor 37 is low. The supply to the coils is cut off when both signals are low. This principle, used in electric motors known as "autosynchronous", is shown schematically in FIG. 4 by the two double switches 44 and 45 which are respectively closed by high signals from sensors 36 and 37. These switches may be formed of thyristors.

Figure 4:
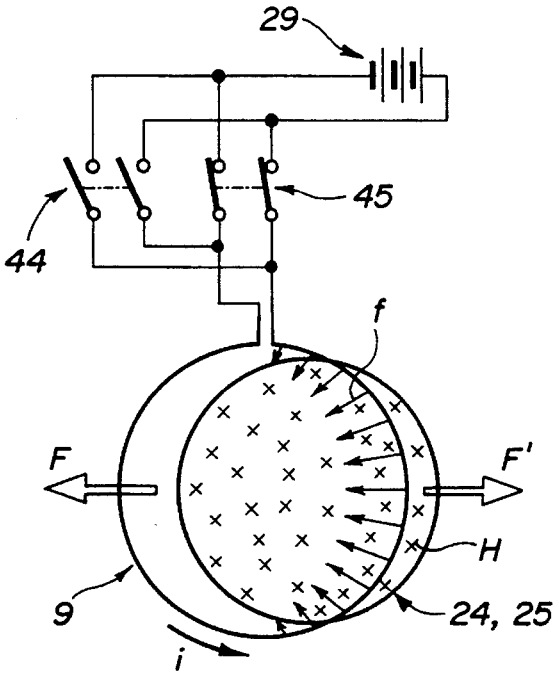
FIG. 4 is a schematic view of the force exerted on one coil of the stator of the electric motor.
Figure 5:
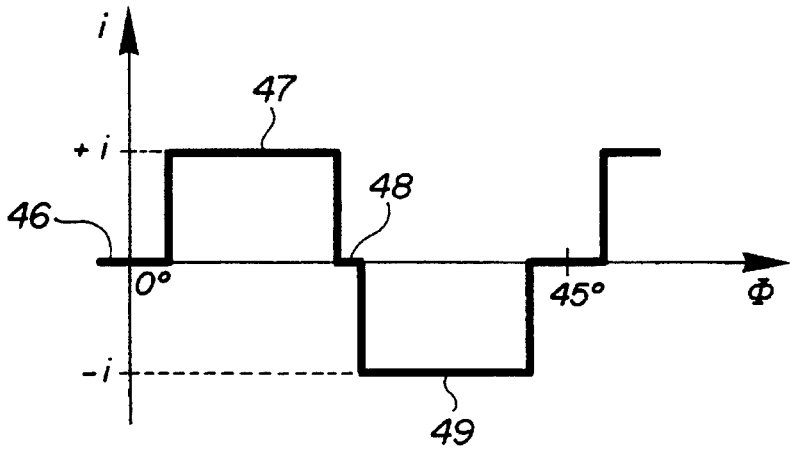
FIG. 5 is a diagram of the current applied to one coil of the stator as a function of rotor position.

FIGS. 3 through 5 demonstrate the principles of how the electric motor functions. FIG. 3 shows the constant and generally uniform magnet field H between the two magnets 24 and 25 on the rotor, said field traversing coil 9 which passes between the magnets. In the case when a current i runs through coil 9 which is not perfectly aligned with the magnets, it is subjected to resultant force F perpendicular to the lines of field H. This force may attract or repel depending upon the direction of current i. Actually, as seen in FIG. 4, each elementary portion of a conductor through which current i passes in coil 9 is subjected to an elementary force f perpendicular to said portion and to H, in accordance with the laws of Lorentz. If the coil is circular, the force takes a radial direction. Since field H is negligible beyond the area situated between the two magnets, forces f produce a non-null resultant F when a portion of coil 9 is outside this area. If the pairs of magnets 24, 25 and coils 9 are located at the same distance from axis 3, each force F takes a tangential direction. Of course each force F exerted on a coil corresponds to a reaction F' in the opposite direction acting on the pair of magnets 24, 25 and thus causing rotor 1 to rotate.

The borders between white areas 40, 41 and black areas 42, 43 on tracks 38, 39 are angularly disposed in relation to the pairs of magnets 24, 25 on the rotor so that they switch the current i in each coil as a function of the angle of rotation Φ of the rotor as shown in FIG. 5. In a first phase 46 when the pairs of magnets are located between two successive coils, supply to the coils is cut off In a second phase 47 when the magnets approach the coils, sensor 36 is located opposite a white area 40 and closes switches 44, causing current +i (considered to be constant for purposes of simplification) to pass through each coil. The current is then cut off during a brief phase 48 when the coils are actually aligned with the magnets, then a white area 41 passes in front of sensor 37, thereby closing switches 45 and causing a current-i to pass through the coils during phase 49. Next the switching cycle begins again, each cycle covering an angle Φ of 45°, representing 360° divided by the number of pairs of magnets. The total length of the attraction and repulsion phases, 47 and 49, respectively, covers the largest portion of the cycle length. To dictate the rotor from an angular position corresponding to one of phases 46 and 48 where the coils are not being supplied, a stop-start switch can be provided to deliver an electrical impulse to the coils at the moment of deactuation.

Naturally the number of stator coils 9 is not necessarily equal to the number of pairs of magnets 24, 25 on the rotor. With a coil supply diagram such as that shown in FIG. 5, the number of coils may be one more or one less than the number of pairs of magnets to ensure that at least one coil is active during the time the rotor is in the angular position, thereby eliminating any stopping and reducing the amplitude of variations in current consumed. In this case, there are various possible solutions for successively controlling the cycles which supply the coils. A first solution consists of providing each coil 9 with its own switch 28 and its own sensors 36 and 37 cooperating with tracks 38 and 39 of FIG. 2. A solution with a simpler construction is to use only one sensor and a more elaborate electronic switch. The sensor can detect equidistant markings on a circular path on the rotor. The angular separation between these markings is equal to the difference between the angle which separates two successive magnets and the angle which separates two successive coils. The signal delivered by such a sensor is sufficient for the switch to produce cycles, as shown in FIG. 5, with suitable angular separations for each coil.

A person skilled in the art will recognize that the construction described with reference to FIGS. 1 through 5 allows the pump to run at very high speeds, possibly as high as several tens of thousands of rotations per minute. Thus the size of blades 16 can be reduced and consequently the length of central channel 14 and of the entire pump, since the electric motor itself is not very long. More specifically, the total length L of rotor 1 is smaller than its diameter D. The resulting electric pump is compact but powerful.

Furthermore, a person skilled in the art will recognize that a machine designed like the pump described above can function as an electric turbogenerator if the central portion of the rotor is designed as an axial turbine to transform kinetic energy, and/or the energy from the pressure of fluid passing through central channel 14, into electrical energy. Because this channel is rectilinear in design, such a turbine may be easily interposed on pipe network, for example, on a water main.

Figure 6:
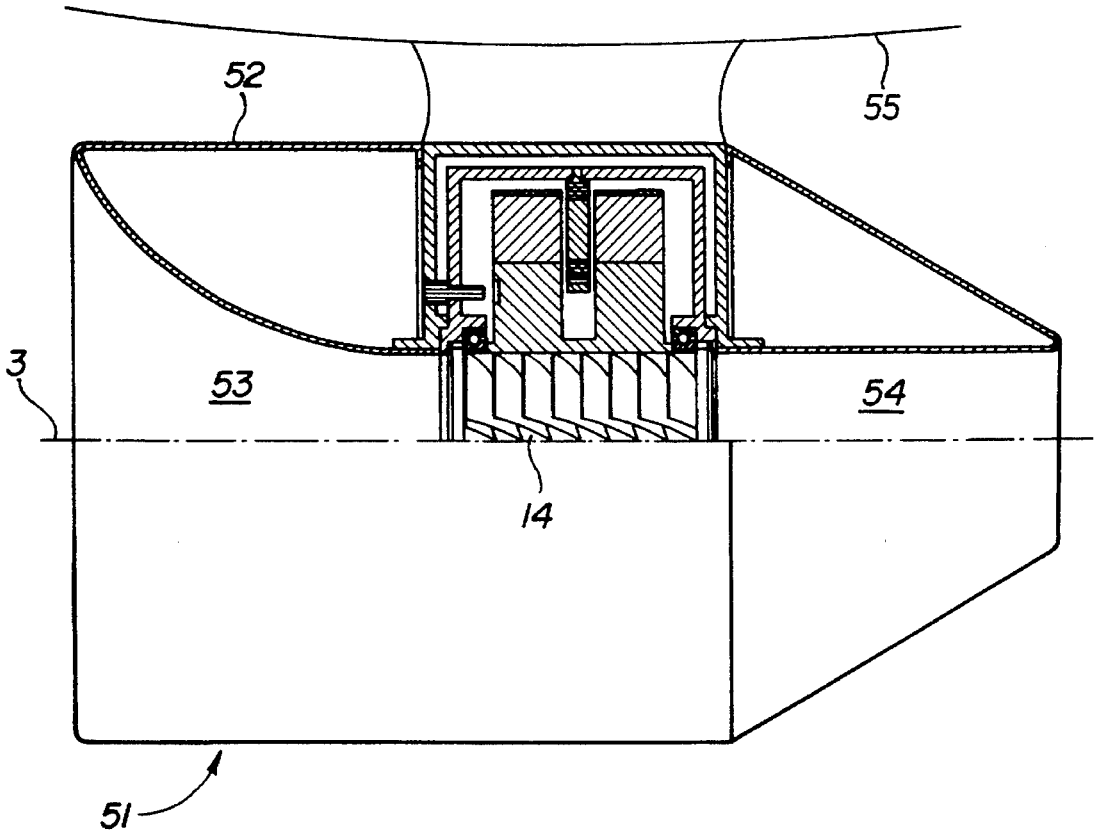
FIG. 6 is analogous to FIG. 1 and shows the pump used to drive a boat.

The pump according to the invention is generally useful in any application requiting centrifugal axial-flow pumps, and is useful for liquids as well as gases. It is especially advantageous when the fluid is not particularly pure, thanks to the rectilinear form of the central channel and the unobstructed opening at the center of the channel. A particularly interesting application is for electrically driven surface vessels or submarines. FIG. 6 shows the design of a pump according to FIGS. 1 and 2 in a streamlined tubular body 51 for exterior attachment to the hull of a boat such as a submarine. Body 51 may have an exterior casing 52 which is generally cylindrical in the front and tapered in the back. Central conduit 14 of the rotor is preceded by an inlet pipe 53 and ends in a cylindrical outlet pipe 54 which evacuates water at high speed to propel the boat by reaction.

Figure 7:
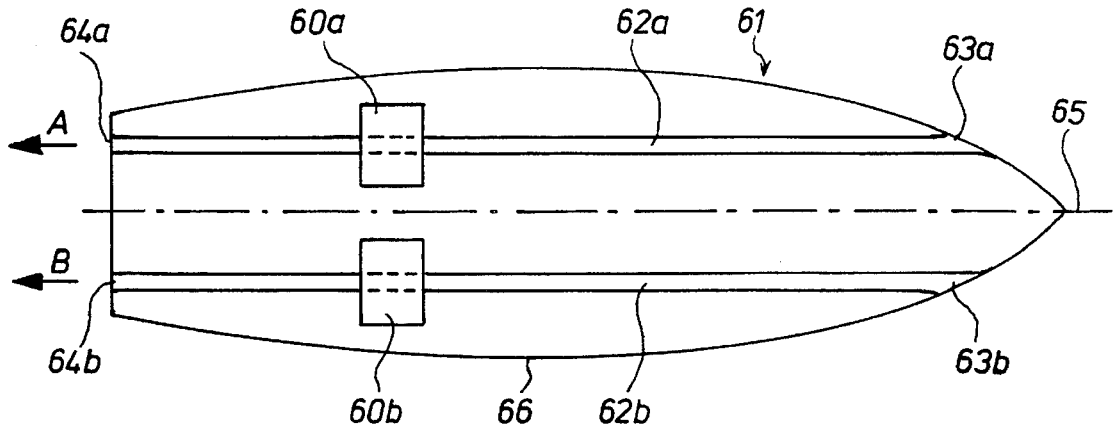
FIG. 7 is a plane schematic view of a boat driven by pumps according to the invention.
Figure 8:
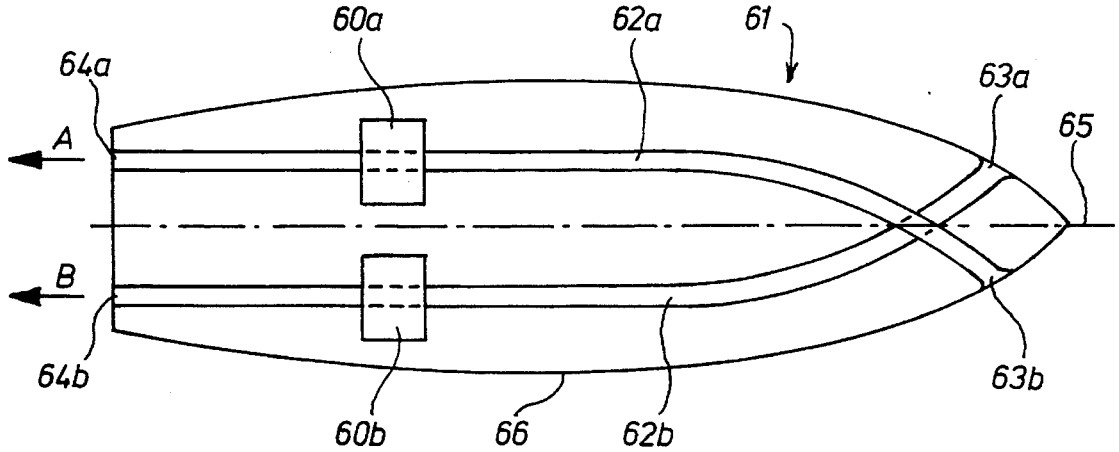
FIG. 8 shows a variation of the boat shown in FIG. 7.

FIGS. 7 and 8 are schematic illustrations of another application wherein two axial pumps 60*a* and 60*b* according to the invention are mounted on a boat 61 to propel it using streams of water A and B. Each pump connects to respective propulsion channel 62*a*, 62*b* which has an inlet 63*a*, 63*b* at the front of the boat and an outlet 64*a*, 64*b* at the rear to produce stream A, B. Normally each outlet is directed parallel to the longitudinal axis 65 of the boat, but it may also be turned in order to maneuver the boat. However, the crossed arrangement of channels 62*a* and 62*b* according to FIG. 8 also allows maneuvers to be performed by controlling the speed of pumps 60*a* and 60*b*. Since inlet 63*a* is on the side of axis 65 which is opposite corresponding outlet 64*a*, suctioning water on the fight side of hull 66 tends to make the boat turn in the same direction as the offset push of stream A, that is, to the right. Thus, the boat can be turned right or left by simply controlling the difference in speed between pumps 60*a* and 60*b*.

While the examples described above relate primarily to applications using liquid, a pump according to the invention may also be designed for use with a fluid gas, particularly as a compressor or blowing device. In this instance the central channel may have a large diameter and its transverse section may vary progressively depending upon the compression imposed on the gas by the particular blade configuration. In all these applications there may be a circuit of cooling fluid consisting of pipes in the space between frame 10 and inner casing 8 to circulate in the channels 50 (FIG. 1) surrounding coil 9.

We claim:

1. A high speed electrically driven axial-flow pump comprising a stator with a sealed casing, a rotor located inside said stator casing so that it can rotate on an axis of rotation, said rotor having a tubular central portion forming an exterior wall of a central channel for receiving a continuous axial flow of a liquid, with blades in said channel; and electromagnetic drive means for driving said rotor comprising, magnets on the rotor being arranged around said tubular central portion, said magnets cooperating with electrical coils on the stator which are inside said sealed casing, wherein the rotor is shorter in length than an exterior diameter of the rotor.

2. A pump according to claim 1 wherein the blades are closely spaced helices.

3. A pump according to claim 2 wherein the central channel is generally cylindrical and the space between helices is smaller than an inner diameter of the central channel.

4. A pump according to claim 1 wherein the blades are attached to said exterior wall of the central channel and do not extend as far as the axis of rotation, so that the channel has a free central area along its entire length.

5. A pump according to claim 1 wherein said magnets on the rotor are arranged in pairs of two, the two magnets in each pair being axially separated by a space into which the magnets emit a generally uniform magnetic field directed from one magnet to the other, and wherein the coils on the stator are formed of flattened coils arranged in a circle in a radial plane that is located in said spaces between the rotor magnets of each pair, so that each coil is generally perpendicular to the lines of the magnetic field in these spaces.

6. A pump according to claim 5 wherein the rotor magnets are permanent magnets.

7. A pump according to claim 5 wherein the rotor magnets are electromagnets.

8. A pump according to claim 5 wherein the electromagnetic drive means has a control means consisting of at least one position sensor attached to the stator for delivering a signal indicating the angular position of the rotor, and electronic switching means to individually actuate and deactuate the stator coils depending upon the signal from the at least one position sensor.

9. A pump according to claim 5 wherein each of the stator coils is surrounded by a peripheral channel for circulating cooling fluid.

10. A boat driven by pumps according to claim 1 wherein each pump is situated in a streamlined body located in water outside a hull of the boat and each pump is traversed by an axial channel comprising said central channel of the pump rotor.

11. A boat driven by pumps according to claim 1 further comprising at least two propulsion channels being essentially longitudinally disposed inside the boat, each propulsion channel traversing one of said pumps and each propulsion channel having an inlet at a front of the boat and a longitudinally directed outlet at a rear of the boat, wherein the inlet and the outlet of each of the at least two propulsion channels are respectively situated on opposite sides of a longitudinal central axis of the boat.

12. An electrically powered axial pump for use in propulsion of a vehicle on a fluid, said electrically powered axial pump comprising a stator with a sealed casing, a rotor located inside said stator casing so that it can rotate on an axis of rotation, said rotor having a tubular central portion forming an exterior wall of a central channel for receiving a continuous axial flow of a liquid, with blades in said channel; and electromagnetic drive means, for driving said stator, comprising magnets on the rotor being arranged around said tubular central portion, said magnets cooperating with electrical coils on the stator which are inside said sealed casing, wherein the rotor is shorter in length than an exterior diameter of the rotor.

13. An electrically powered axial pump according to claim 12, wherein said vehicle is a boat and said fluid is water, and each pump is situated in a streamlined body located in the water outside a hull of the boat and each pump is traversed by an axial channel comprising said central channel of the pump rotor.

14. An electrically powered axial pump according to claim 12, wherein said vehicle is a boat and said fluid is water, and at least two propulsion channels are essentially longitudinally disposed inside the boat, each propulsion channel traversing one of said pumps and each propulsion channel having an inlet at a front of the boat and a longitudinally directed outlet at a rear of the boat, wherein the inlet and the outlet of each of the at least two propulsion channels are respectively situated on opposite sides of a longitudinal central axis of the boat.

15. An axial pump according to claim 1, wherein said rotor is sized and shaped to allow the rotor to rotate at high speeds exceeding 1000 turns per second.

16. An axial pump according to claim 15, wherein said rotor is substantially disk-shaped outside said central channel and has an outer diameter of about 3 times an inner diameter of said central duct.

* * * * *